US005149432A

United States Patent [19]

Lavin

[11] Patent Number: 5,149,432

[45] Date of Patent: Sep. 22, 1992

[54] CENTRIFUGE FOR SEPARATING LIQUIDS OF DIFFERENT SPECIFIC GRAVITIES

[76] Inventor: Aaron Lavin, 3500 Davisville Rd., Hatboro, Pa. 19040

[21] Appl. No.: 693,491

[22] Filed: Apr. 30, 1991

[51] Int. Cl.[5] ..... B04B 9/00

[52] U.S. Cl. ..... 210/381; 210/360.1; 210/378; 210/379; 210/380.1; 210/512 B; 494/27; 494/36; 494/43; 494/60; 494/901

[58] Field of Search ..... 210/360.1, 365, 367, 210/378, 379, 381, 512 B, 380.1, 787; 494/22, 27, 43, 60, 901, 36

[56] References Cited

U.S. PATENT DOCUMENTS

| | | | |
|---|---|---|---|
| 3,075,693 | 1/1963 | Dega | 494/36 |
| 3,332,614 | 6/1967 | Webster et al. | 494/22 |
| 4,362,619 | 12/1982 | Bange | 210/360.1 |
| 4,895,666 | 1/1990 | Franzen et al. | 494/36 |
| 4,959,158 | 9/1990 | Meikrantz | 210/787 |

*Primary Examiner*—Robert A. Dawson
*Assistant Examiner*—David Reifsynder
*Attorney, Agent, or Firm*—Caesar, Rivise, Bernstein, Cohen & Pokotilow, Ltd.

[57] ABSTRACT

A centrifuge for separating liquids, e.g., oil from water. The centrifuge basically comprises a housing having first and second cavities, and a liquid conveying wall disposed over a bowl arranged to be rotated about a central axis. The bowl includes an annular top wall having an annular separator plate including a central hub mounted below the top wall. The separator plate is spaced from the bowl to enable the second liquid to flow therebetween and into the space between it and the top wall. The hub has plural radial passageways in communication with the space between the separator plate and the top wall and also with the space between the top wall and the liquid conveying wall. The hub also has plural axial passageways communicating with the interior of the bowl and located at the interface of the two liquids formed when the bowl is rotated. Each axial passageways has an outlet in communication with the liquid conveying wall. When the bowl is rotated about the axis the first liquid flows through the radial passageways to the first cavity and the second liquid flows through the axial passageways to a second cavity.

14 Claims, 3 Drawing Sheets

CENTRIFUGE FOR SEPARATING LIQUIDS OF DIFFERENT SPECIFIC GRAVITIES

BACKGROUND OF THE INVENTION

This invention relates generally to centrifuges and more particularly to centrifuges for effecting the continuous separation of insoluble liquids having different specific gravities.

Centrifuges have been used for many years to remove insoluble contaminants from a liquid. For example centrifuges have been used for separating a lighter phase liquid, e.g., oil, from a heavier phase liquid, e.g., water. Such centrifuges typically include a housing in which a rotary basket or bowl is disposed. The contaminated liquid, e.g., the mixture of liquids to be separated, is introduced into the bowl (typically through a opening in the top wall of the bowl). The bowl is rotated or spun about a vertical axis at a high rate of speed to cause the liquids to accelerate and separate, with the heavier phase (i.e., higher specific gravity) material being displaced into an annular volume located on the sidewall of the centrifuge bowl and the lighter phase material being displaced into another annular volume located on top of ("floating") on the heavier phase liquid. A respective outlet or "escapement" is provided in communication with each liquid volume to enable that liquid to be withdrawn from the bowl, while the contaminated liquid, i.e., the mixture of the two different phase liquids is introduced therein. For example, in one common type of centrifuge the bowl or basket utilizes a conical separator plate to establish the two annular volumes, with the escapements for those volumes being located closely adjacent the rotation axis. In another type of centrifuge no conical separation plate is used, but the outlets or escapements for the two liquids are still located closely adjacent the rotation axis. Both of these types of prior art centrifuges are somewhat complex in construction and of limited utility.

Clinton Centrifuge, Inc. of Hatboro, Pa. markets a centrifuge under the trademark CLINTON LIQUID-LIQUID SEPARATOR for accomplishing the reclamation of a lighter phase liquid from a higher phase liquid which is simpler in construction than many other types of prior art centrifuges. Moreover the CLINTON LIQUID-LIQUID centrifuge effects the removal of the two liquids from positions radially remote from the rotation axis to expedite the separation procedure by taking advantage of the increased centrifugal forces extant at the radially remote positions. In particular the CLINTON LIQUID-LIQUID centrifuge includes a housing having a basket therein which is rotated or spun about a vertical axis at a high rate of speed to cause the liquids to accelerate and separate, with the heavier phase liquid being displaced into a cylindrical annular volume located on the sidewall of the centrifuge bowl and with the lighter phase material being displaced into another annular cylindrical volume floating on the heavier phase liquid. A sharp edged "skimmer" tube is mounted in the housing to extend into the lighter phase liquid volume in the bowl to cause that liquid to be intermittently discharged under pressure into the skimmer. In particular the skimmer tube extends through a central opening in the top wall of the bowl radially remote from the rotation axis and includes a razor edged radially outwardly extending portion arranged to be adjustably positioned in the annular volume of the lighter phase material to skim it off. The skimmer tube is coupled to a conduit in the housing through which the reclaimed lighter phase liquid flows to an outlet for coupling to external means for collecting that liquid. A horizontally disposed ring is located within the centrifuge basket spaced inwardly from the basket's sidewall and below its top wall to form an annular passageway through which the heavy phase liquid may flow for ultimate gravity discharge. To that end the heavy phase liquid which exits that annular passageway flows around the inner lip of the top wall of the basket and over it to a chamber located within the housing below the basket. That chamber includes an outlet arranged to be coupled to means for collecting the heavy phase liquid.

While the CLINTON LIQUID-LIQUID SEPARATOR centrifuge is suitable for its intended purposes and is somewhat simpler in construction than many other prior art liquid separation centrifuges, it never the less still leaves something to be desired from the standpoint of effectiveness and efficiency of operation.

OBJECTS OF THE INVENTION

Accordingly, it is a general object of this invention to provide a centrifuge which overcomes the disadvantages of the prior art.

It is another object of this invention to provide a centrifuge for separating insoluble liquids having different specific gravities.

It is still another object of this invention to provide a centrifuge for separating insoluble liquids having different specific gravities which is simple in construction.

It is yet another object of this invention to provide a centrifuge for separating insoluble liquids having different specific gravities which is effective in operation.

It is another object of this invention to provide a centrifuge for separating insoluble liquids having different specific gravities without spillage or splashing.

SUMMARY OF THE INVENTION

These and other objects of this invention are achieved by providing a centrifuge for separating a first insoluble flowable material, e.g., oil, having a first specific gravity from a second flowable material, e.g., water, having a second and higher specific gravity. The centrifuge basically comprises a bowl, a conveying wall, first means in communication with the conveying wall for receipt of the first material, e.g., oil, and second means for receipt of the second material, e.g., water.

The bowl is arranged to be rotated about a rotation axis and comprises a circular sidewall extending around the axis and an annular top wall projecting radially inward from the sidewall. When the bowl is rotated it causes the first material to be disposed on top of the second material to form an interface located at a first predetermined radial distance from the rotation axis. The bowl additionally comprises an annular separator plate and a central hub. The separator plate is spaced below the top wall and from the sidewall. The top wall of the bowl is disposed below the conveying wall to form a space therebetween in communication with the second means. The second material is able to flow into the space between the separator plate and the top wall.

The hub has at least one radial passageway extending radially through it in communication with the space between the separator plate and the top wall and with the space between the top wall and the conveying wall. The hub also has at least one axial passageway extending through it. The axial passageway has an outlet opening in communication with the conveying wall and an entrance opening in communication with the interior of the bowl located at a second predetermined radial distance from the axis. The second distance is smaller than the first distance. Thus, when the bowl is rotated the first material flows through the radial passageway to the first means and the second material flows through the axial passageway to the second means.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
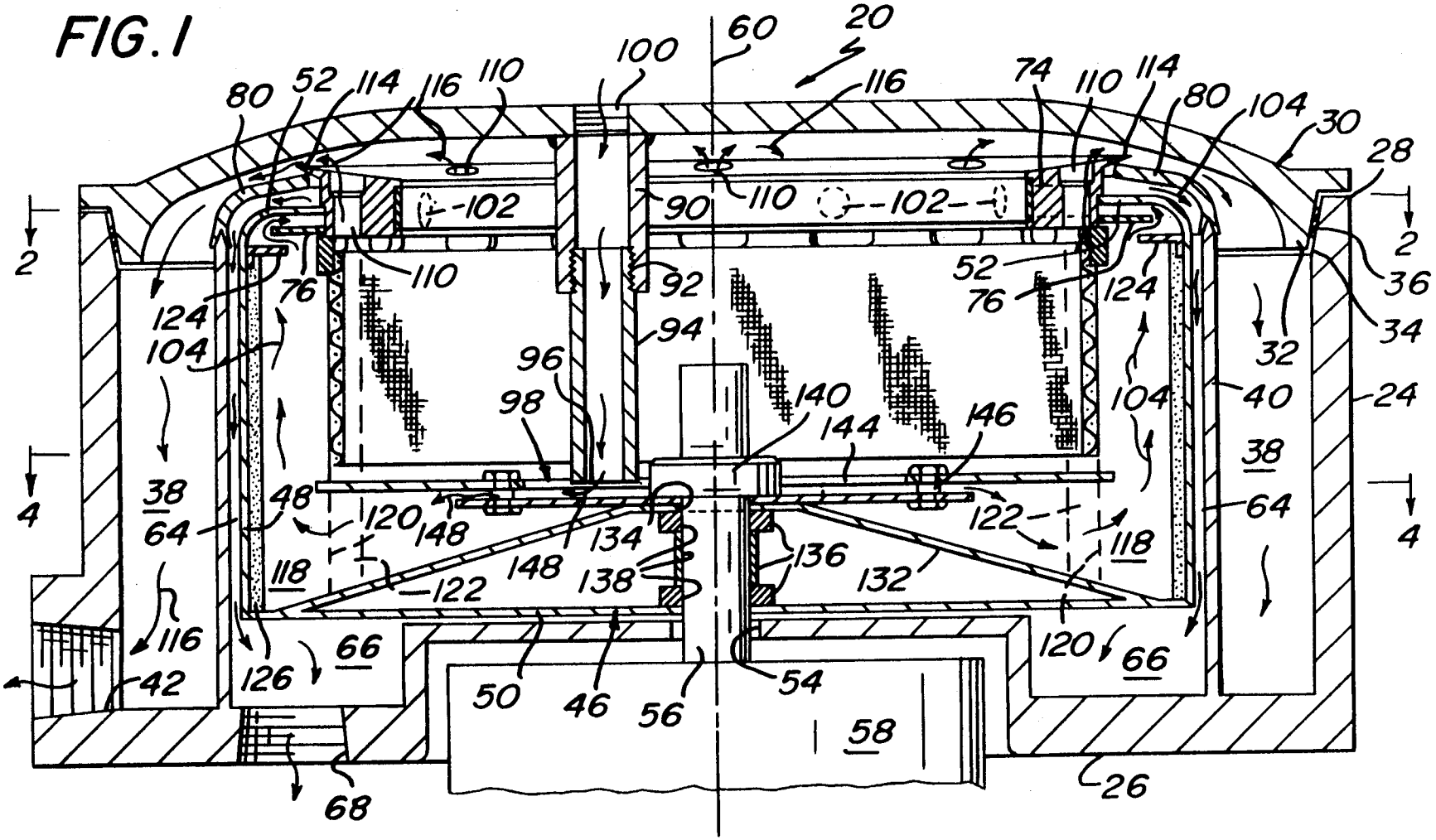
FIG. 1 is a vertical sectional view of a centrifuge constructed in accordance with this invention.

Referring now to various figures of the drawing where like reference numerals refer to like parts there is shown at 20 in FIG. 1 a centrifuge constructed in accordance with this invention. The centrifuge is particularly suitable for separating a contaminated liquid into its constituents. It should b pointed out at this juncture that the use of the term "contaminated liquid" is merely a shorthand way of identifying a mixture of two liquids or other types of flowable materials having differing specific gravities which can be separated by centrifugation. Thus, the use of the term liquid in the description to follow is also exemplary and not limiting. In the embodiment to be described hereinafter the "contaminated liquid" comprises a mixture of water and a typical oil, e.g., motor oil. Due to the higher specific gravity of water it is referred to hereinafter as the heavier phase liquid, while the oil is referred to as the lighter phase liquid.

The centrifuge includes a housing 22 or shell in the form of a hollow member having a generally circular outside wall 24 and a generally flat bottom wall 26. The top 28 of the housing is open, but is arranged to be closed by a lid or cover 30. The cover 30 includes an annular flared flange 32 which is arranged to be received within a matingly shaped, annular surface 34 on the inner periphery of the side wall 24 at the top end thereof. A resilient material, e.g., rubber, gasket 36 is located at the interface of the cover 30 and surface 34 to act as a seal and thereby ensure that no liquid exits from the interior of the housing when the centrifuge is operated.

An annular chamber 38 is located within the housing 22 between the circular outside wall 24 and an intermediate cylindrical wall 40. The chamber 38 is arranged to receive the lighter phase liquid which is separated by the centrifuge from the contaminated liquid introduced therein. A threaded outlet 42 is located in the housing's outside wall 24 at the lower end thereof and communicates with the interior of the chamber 38 to enable a conduit or some other means (not shown) to be coupled thereto to receive the reclaimed lighter phase liquid from the centrifuge.

The intermediate cylindrical wall 40 also forms a central cavity or chamber 44 in which the centrifuge bowl or basket 46 is located. The bowl 46 basically comprises a hollow member having a circular side wall 48, a flat bottom or base wall 50, and a top wall 52.

The bottom wall 26 of the centrifuge housing 24 includes a central hole 54 through which a drive shaft 56 of an electric motor 58 extends. The bowl 46 is mounted on the drive shaft 56, in a manner to be described later, so that it can be rotated at a high rate of speed about the longitudinal central axis 60 of the drive shaft by the operation of motor 58. The motor 58 is located within a centrally located circular recess 62 in the bottom wall 26 of the centrifuge housing, with its drive shaft 56 extending through the hole 54.

With the centrifuge bowl 46 disposed within the confines of the intermediate wall 40 a thin annular space or passageway 64 is formed between the outer periphery of the bowl's side wall 4 and the inner surface of the intermediate wall 40. Moreover, another annular space or chamber 66 is formed between the bottom wall 50 of the bowl 46 and the inner surface of the housing's bottom wall extending around the recess 62. The chamber 66 is in communication with the annular passageway 64 and serves to receive or collect the heavier phase liquid which is separated by the centrifuge. A threaded outlet 68 is located in the housing's bottom wall 26 and communicates with the interior of the chamber 66 to enable a conduit or some other means (not shown) to be coupled thereto to receive the reclaimed heavier phase liquid from the centrifuge.

Figure 3:
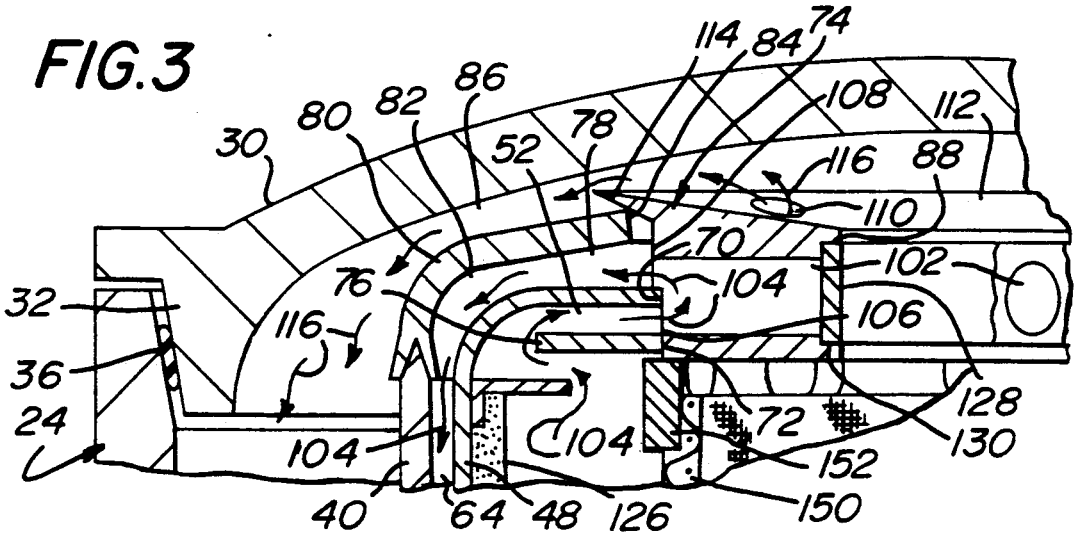
FIG. 3 is an enlarged sectional view taken along line 3—3 of FIG. 2.

As can be seen clearly in FIG. 3, the top wall 52 of the bowl 46 basically comprises a radially inwardly directed annular flange located at the top of the bowl's side wall 48. In fact, the top wall of the bowl is merely an extension of the side wall of the bowl. The inner periphery of the top wall 52 is in the form of a circular rim 70 which abuts and is connected to an undercut surface 72 on the outer periphery of a ring or hub member 74 to form a water-tight, air-tight seal therebetween. An annular, flat disk or separator plate 76 is also mounted on the undercut surface of the hub member 74 to form a water-tight, air-tight seal therebetween. The separator plate 76 is located slightly below the circular rim 70 of the top wall 52 and forms an annular space or passageway 78 through which the heavier phase liquid may flow once separated from the lighter phase liquid by the operation of the centrifuge.

The intermediate wall 40 of the centrifuge housing terminates at its upper end in an inwardly directed flange or wall member 80 which is disposed above and spaced from the top wall 52 of the bowl to form yet another annular passageway communicating with the annular passageway 82. The annular passageways 78 and 82 are in fluid communication with each other via a plurality of radially extending passageways or openings (to be described in detail later) in the hub member 74. It is through the communicating annular passageways 78 and 82 and the radially extending passageways that the separated heavier phase liquid flows to annular passageway 64 and from there to the inner annular receiving chamber 66, as will be described later.

As can also be seen clearly in FIG. 3 the flange or wall 80 is conical or umbrella-like in shape and slopes downward from its inner peripheral lip 84 to its merger with the vertical portion of the intermediate wall 40.

This downward sloping surface serves to transport or convey the lighter phase liquid from the interior of the centrifuge bowl 46 to the outer annular receiving chamber 38. Thus, the top surface of the flange 80, referred to hereinafter as a conveying wall, is spaced below the inner surface of the centrifuge cover 34 to form another annular passageway 86 communicating with the top of the outer annular receiving chamber 38.

Referring now to FIGS. 3–3, the hub 74 is in the form of a relatively thin, e.g. 1⅝ (4.13 cm) ring having a large diameter, e.g., 6⅛ (15.6 cm), central opening 88 therein. It is through the central opening that the contaminated liquid, e.g., the oil and water mixture, is introduced into the centrifuge bowl 46. Thus, a rigid conduit 90 (FIG. 1) is fixedly mounted, e.g., welded, on the underside of the centrifuge cover 30 at position which is slightly offset radially from the axis 60 of rotation of the bowl 46. The conduit 90 includes a internally threaded lower end 92 into which a short externally threaded pipe section 94 is screwed. The pipe section 94 terminates in an outlet or opening 96 immediately adjacent a diffuser system or assembly 98 (to be described later) located within the centrifuge bowl 46. The details of the diffuser assembly 98 will be described later. Suffice it for now to state that the diffuser assembly is arranged to receive the contaminated liquid to direct it into a high gravity field within the interior of the bowl for separation of its constituent liquids and for trapping any sludge forming particles within the bowl. To that end an internally threaded inlet 100 is provided in the centrifuge cover 30 communicating with the interior of the conduit 90. The inlet 100 serves as a means for connecting the centrifuge to some means (not shown) providing the contaminated liquid to the centrifuge.

As mentioned earlier the hub member 74 includes plural radially extending passageways or openings for enabling the flow of the heavier phase liquid from the centrifuge bowl to the inner annular receiving chamber 66. In particular the hub 74 comprises plural radially extending passageways or openings 102 disposed at equidistantly spaced locations to carry the heavier phase liquid from the annular passageway 78 (which as can be seen in FIG. 3 is in communication with the interior of the bowl) to the annular passageway 82, from whence it flows into the annular passageway 64 to the inner annular receiving chamber 66. Thus, the communicating passageways 78, 102, 82, and 64 from the interior of the bowl 46 to the heavier phase liquid receiving chamber 66 will be referred to hereinafter as the "heavy phase liquid path." The path of the heavier phase liquid, e.g., water, through the heavier phase liquid path is shown by the arrows designated by the reference numerals 104 in FIGS. 1–3. Each of the radially extending passageways 102 includes an inlet 106 located in communication with the annular passageway 78 (which is located between the plate 76 and the top wall 52 of the bowl), and an outlet 108 in communication with the annular passageway 82 (which is located between the top wall 52 of the bowl and the flange 80 of the intermediate wall 40).

Figure 4:
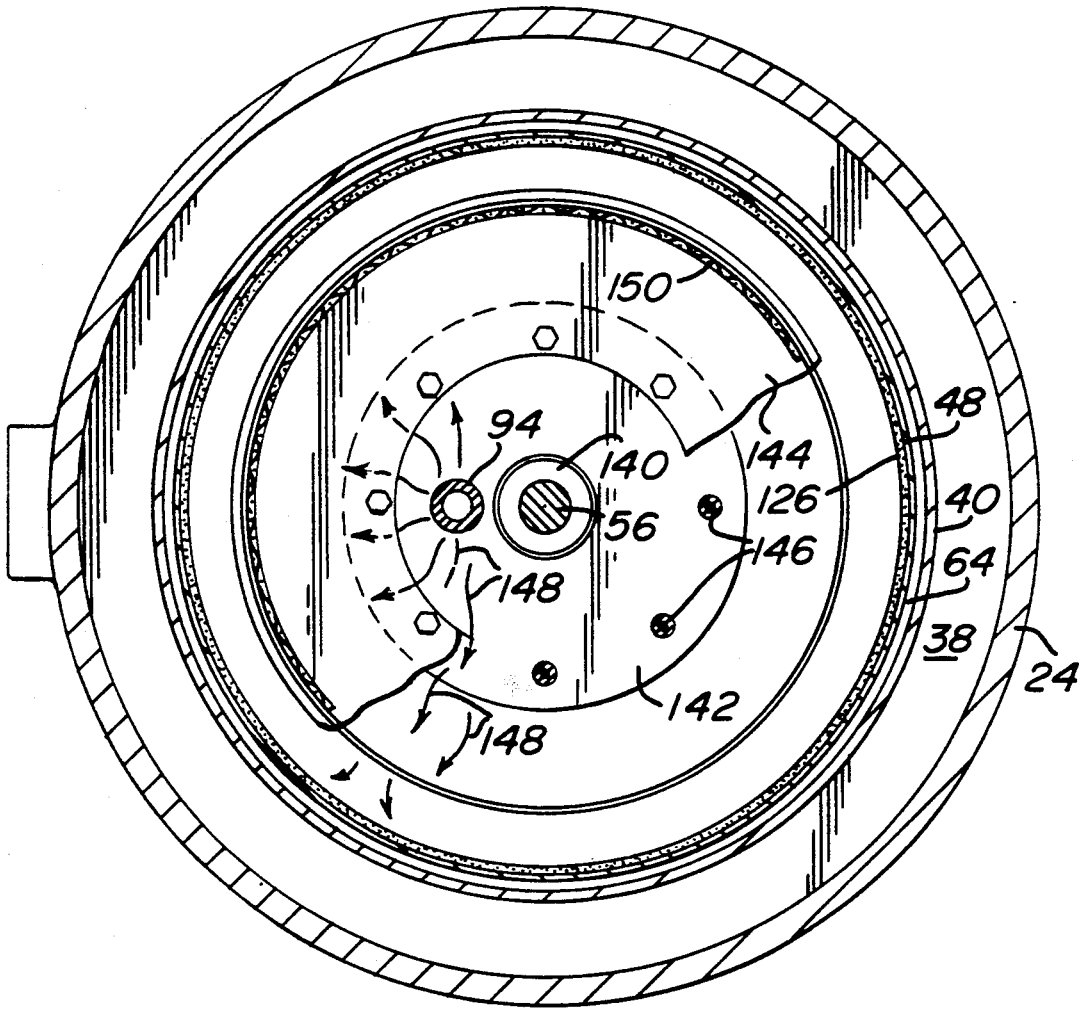
FIG. 4 is a reduced sectional view taken along line 4—4 of FIG. 1.

The hub 74 also includes plural, axially extending passageways 110 communicating with the interior of the bowl 46 for transporting the lighter phase liquid to the outer annular receiving chamber 38. The axially extending passageways 110 will now be described. Thus, as can be seen clearly in FIGS. 1, 3, and 4 the hub 74 includes a top surface 112 which inclines upward in a radially outward direction and terminates in a sharp edged annular flange 114 disposed over the inner peripheral rim 84 of the wall 80. The passageways 110 serve to carry the lighter phase liquid from the interior of the bowl to the flange 112. In particular, the centrifugal force created by the rapid spinning of the bowl 46 causes the lighter phase liquid to pass through the passageways 110 onto the flange 112 from where it is thrown off of the knife edge 114 onto the conveying wall surface 80, from whence it flows into the annular passageway 86 to the outer annular receiving chamber 38. Thus, the communicating passageway 110 and 86 from the interior of the bowl 46 to the chamber 38 will be referred to hereinafter as the "lighter phase liquid path." The flow of the lighter phase liquid, e.g., oil, through the lighter phase liquid path is shown by the arrows designated by the reference numerals 116 in FIGS. 1–3. The flange 112, being sloped, ensures that upon slowing of rotation of the centrifuge bowl the lighter phase material will flow or drain back into the bowl.

Figure 2:
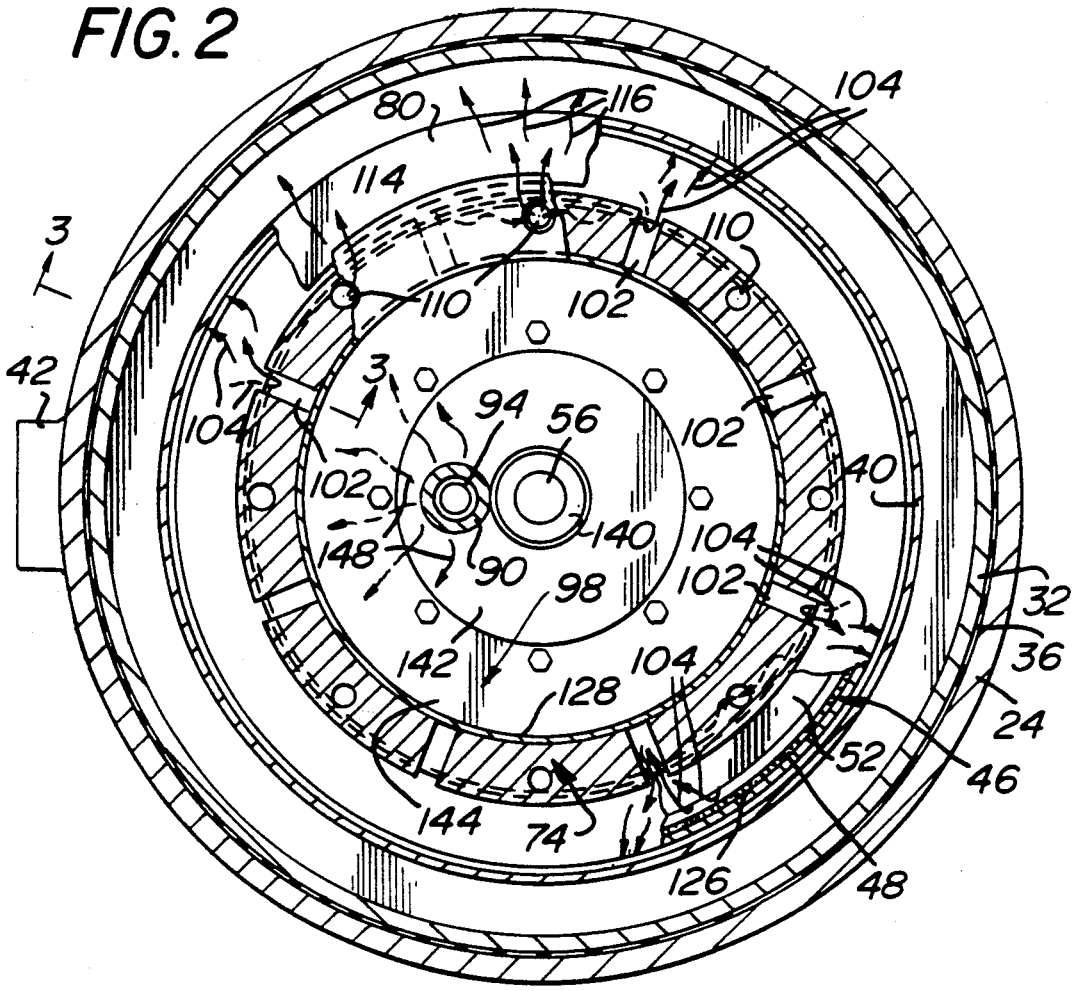
FIG. 2 is a reduced sectional view taken along line 2—2 of FIG. 1.

As can be seen clearly in FIGS. 1 and 2 each of the axial extending passageways 110 is located closely adjacent the outer periphery of the hub 74 so that only a very small thickness of the material, e.g., aluminum, forming the hub is located between the outermost peripheral portion of the passageway 110 and the outer peripheral surface 72 of the hub 74 for reasons to be discussed later.

As will be appreciated by those skilled in the art from the explanation to follow the centrifuge bowl 46 is constructed so that when the centrifuge is operated, i.e., the bowl is spinning at a high rate of speed, the heavier phase liquid is confined within a cylindrical annular space or volume 118 (FIG. 1) located between the inner surface of the bowl's side wall 48 and a cylindrical boundary 120 extending downward from the undercut outer surface 72 of the hub 74, while the lighter phase liquid is located within a cylindrically annular space or volume 122 disposed about the volume 118, with the boundary 120 forming the interface between the two liquids.

In order to ensure that the heavier phase liquid is confined within the annular volume 118 to have access to only the heavier phase liquid path, while also ensuring that the lighter phase liquid is confined within the annular volume 122 to have access to only the lighter phase liquid path, the passageways 78 and 110 are located at predetermined positions in the bowl 46. In this regard, as seen in FIG. 3, the annular passageway 78 communicates with the annular volume 118 close to the inner surface of the bowl's side wall 48. The axially oriented passageways 110 are located so that their inlets are located a small radial distance inward from the outer surface 7 of the hub 74. Accordingly, portions of the inlets of the axial passageways 110 communicate with the annular volume 122 containing the lighter phase liquid but do not communicate with the annular volume 118 containing the heavier phase liquid.

In accordance with a preferred embodiment of this invention the thickness of the annular volume 118, i.e., the radial distance from the inner surface of the side wall 48 to the interface 120 is approximately 2 inches (5.1 cm).

As will be appreciated by those skilled in the art if the centrifuge 20 is used to separate a mixture of water and a typical oil, such as motor oil, the specific gravities of these two liquids are such that for the 2 inch (5.1 cm) thickness of water in volume 118 the thickness of the oil which would be disposed on top of the water will not exceed approximately 3/16 inch (0.48 cm). Thus, by locating the axially passageways 110 so that their closest point of approach to the interface 120 is very close, e.g., 1/32 inch (0.08 cm), no portion of those passageways will communicate with the volume 118 containing the water. Moreover, the inside diameter of each of the axial passageways is at least equal to the thickness of the annular volume 122 so that each passageway 110 covers the thickness of the oil layer to expedite its removal from the bowl. With such an arrangement the oil will flow in a thin layer upward along the inner peripheral portion of each of the passageways 110 located furthest from the rotation axis 60, with air being able to flow through the remaining portion of that passageway.

A sludge collector in the form of an annular flange or ring 124 is mounted within the centrifuge bowl 46 below the top wall 52 to trap any sludge 126 or other debris on the inner surface of the sidewall 48 of the bowl so that it is prevented from flowing into the radially extending passageways 102.

The radially extending passageways 102 are disposed at equidistantly spaced locations about the hub 74 and each extends fully therethrough. A sealing ring 128 (FIG. 3) is located (e.g., snap fit) within an annular recess 130 in the inner periphery of the hub 74 to close off the radially inward end of each passageway 102. The ring 128 serves to prevent aeration of the heavy phase liquid, but is preferably removable to enable one to readily clean out the passageways 102 should they become clogged with debris (e.g., sludge) which manages to pass the sludge collector ring 124.

Further details of the construction of the centrifuge bowl 46 will now be considered. As can be seen in FIG. 1 a conical plate 132 is mounted within the bowl 46 over the base wall 50 and it also includes a central opening 134 therein through which the motor shaft 56 extends. A stack of spacer members 136 are disposed between the plate 132 and the base wall 50 and each member includes a central passageway 138 through which the shaft 56 extends. A collar member 140 is press fit about the end portion of the shaft 56 which extends through the conical plate 132. This collar serves to retain the diffuser assembly 98 on top of the plate.

The diffuser assembly 98 cooperates with the in-feed means, e.g., the conduits 90 and 94, to ensure that the contaminated liquid is introduced into the bowl within the high gravity field volume 118 adjacent the bottom of the bowl, from where it is diffused radially outward and separated into the heavier phase and lighter phased liquids. This feature ensures that if the contaminated liquid includes fine particulate material, e.g., material which will form sludge, such particles are trapped on the inner face of the bowl's side wall 48 and do not gain egress from the bowl along with the lighter phase liquid. In this regard if such particles were introduced into the bowl radially inward of the interface 120, even though the particles may have a higher specific gravity than the lighter phase liquid, their small size may enable them to be carried away with the lighter phase liquid as it is withdrawn, thereby contaminating that liquid. Thus, the diffuser assembly 98 basically comprises a relative heavy and rigid circular disk or base plate 142 mounted on the motor drive shaft 56 between the collar 140 and the conical plate 132. A thin, and relatively flexible ring-like member 144 is mounted onto the base plate disk 142 adjacent its outer edge via plural standoffs 146 so that it is spaced slightly thereabove. The outlet or open free end 96 of the pipe section 94 is disposed slightly over the disk 142 and within the central opening in the ring 144 so that the infeed liquid is introduced into the bowl between the disk 142 and the ring 144. The outer diameter of the ring 144 is greater than the inside diameter of the opening 70 at the top of the bowl 46 so that the ring will have to be flexed to fit within the bowl, but once within the bowl it flexes outward so that its outer periphery is located adjacent the inner surface of the side wall of the bowl, i.e., within the annular volume 118. Thus, any particles of material in the contaminated liquid introduced into the centrifuge bowl will be directed by ring 144 radially outward into the high gravity field of volume 118. In this regard the high speed rotation of the bowl cause the liquid to flow outward (as shown by the arrows designated by the reference numerals 148 in FIG. 1) radially from between the members 142 and 144 to form the heretofore identified annular liquid volumes 118 and 122.

In order to prevent the formation of waves on the interface 120 of the two separated liquids a optional porous barrier belt 150 in the form of a cylindrical screen is disposed within the bowl 46 at the interface. The belt 150 is formed of any suitable cellular material which will float on the heavier phase liquid and which enables the lighter phase liquid to readily flow therethrough to gain ingress into the axial passageways 110. The top of the belt 150 includes a castellated heavy ring 152 fixedly secured, e.g., cemented, to the top of the belt 150 to prevent the belt from floating inward or outward of the bowl.

Without further elaboration the foregoing will so fully illustrate my invention that others may, by applying current or future knowledge, adopt the same for use under various conditions of service.

I claim:

1. A centrifuge for separating a first insoluble flowable material having a first specific gravity from a second flowable material having a second and higher specific gravity, said centrifuge comprising a bowl, a flowable material conveying wall, first means in communication with said conveying wall for receipt of said first material, and second means for receipt of said second material, said bowl being arranged to be rotated about a rotation axis and comprising a circular sidewall extending around said axis and an annular top wall projecting radially inward from said sidewall, said bowl when rotated causing said first material to be located closer to said axis than said second material and with an interface located at a first predetermined radial distance from said axis, said bowl additionally comprising an annular separator plate and a central hub, said separator plate being spaced below said top wall and away from said sidewall, said top wall of said bowl being disposed below said conveying wall to form a space therebetween in communication with said second means, said second material being able to flow into the space between said separator plate and said top wall, said hub having at least one radial passageway extending radially through it in communication with the space between said separator plate and said top wall and with the space between said top wall and said conveying wall, said hub also having at least one axial passageway extending through it, said axial passageway having an outlet opening in communication with said conveying wall and an entrance opening in communication with the interior of said bowl and located at a second predetermined radial distance from said axis, said second distance being smaller than said first distance, whereupon when said bowl is rotated said first material flows through said radial passageway to said first means and said second material flows through said axial passageway to said second means.

2. The centrifuge of claim 1 wherein said hub includes a top portion int he form of a flared sidewall terminating in a sharp edge over which said first material flows from said outlet opening of said axial passageway to said conveying wall.

3. The centrifuge of claim 1 additionally comprising a diffuser plate fixedly disposed within the interior of said bowl above said bottom wall.

4. The centrifuge of claim 1 additionally comprising an annular plate fixedly secured within said bowl to the sidewall thereof and located below said separator plate to collect debris thereon.

5. The centrifuge of claim 4 wherein said first means defines a cavity and wherein said second means defines a cavity.

6. The centrifuge of claim 5 wherein said first cavity is disposed around said bowl, and wherein said second cavity is located beneath said bowl.

7. The centrifuge of claim 6 additionally comprising a cylindrical cellular member disposed at said interface.

8. The centrifuge of claim 4 additionally comprising a cylindrical cellular member disposed at said interface.

9. The centrifuge of claim 1 wherein said first means defines a cavity and wherein said second means defines a cavity.

10. The centrifuge of claim 9 wherein said first cavity is disposed around said bowl, and wherein said second cavity is located beneath said bowl.

11. The centrifuge of claim 9 additionally comprising a cylindrical cellular member disposed at said interface.

12. The centrifuge of claim 1 additionally comprising a cylindrical cellular member disposed at said interface.

13. A centrifuge for separating a first insoluble flowable material having a first specific gravity form a second flowable material having a second and higher specific gravity, said centrifuge comprising a bowl, a flowable material conveying wall, first means in communication with said conveying wall for receipt of said first material, and second means for receipt of said second material, said bowl being arranged to be rotated about a rotation axis and comprising a circular sidewall extending around said axis and an annular top wall projecting radially inward form said sidewall, wherein said conveying wall comprises a conical surface sloping downward away from said axis, said first means being disposed adjacent the outer periphery of said conical surface, said bowl when rotated causing said first material to be located closer to said axis than said second material and with an interface located at a first predetermined radial distance from said axis, said bowl additionally comprising an annular separator plate and a central hub, said separator plate being spaced below said top wall and away form said sidewall, said top wall of said bowl being disposed below said conveying wall to form a space therebetween in communication with said second means, said second material being able to flow into the space between said separator plate and said top wall, said hub having at least one radial passageway extending radially through it in communication with the space between said separator plate and said top wall and with the space between said top wall and said conveying wall, said hub also having at least one axial passageway extending through it, said axial passageway having an outlet opening in communication with said conveying wall and an entrance opening in communication with the interior of said bowl and located a second predetermined radial distance form said axis, said second distance being smaller than said first distance, whereupon when said bowl is rotated said first material flows through said radial passageway to said first means and said second material flows through said axial passageway to said second means.

14. The centrifuge of claim 13 wherein said hub includes a top portion in the form of a flared sidewall terminating in a sharp edge over which said first material flows from said outlet opening of said axial passageway to said conveying wall.

* * * * *